US005284074A

United States Patent [19]

Chen

[11] Patent Number: 5,284,074

[45] Date of Patent: Feb. 8, 1994

[54] AUTOMATIC SCREW-DRIVING DEVICE

[76] Inventor: Ho T. Chen, 2F3R, No. 14, Ching Chung St., Tainan, Taiwan

[21] Appl. No.: 990,650

[22] Filed: Dec. 14, 1992

[51] Int. Cl.[5] ..... B25B 23/04

[52] U.S. Cl. ..... 81/434; 81/433; 81/435

[58] Field of Search ..... 81/57.37, 431, 433, 81/434, 435; 221/71

[56] References Cited

U.S. PATENT DOCUMENTS 5,138,913 8/1992 Chen ..... 81/57.37

*Primary Examiner*—D. S. Meislin

*Attorney, Agent, or Firm*—Pro-Techtor International

[57] ABSTRACT

An automatic screw-driving device including a sliding box and a sprocket to move a screw belt through the sliding box, the sprocket being locked at one of various positions to keep a screw on the screw belt at a secured position for a driver rotated by an electric motor to fix in something, the sprocket being rotated by a shaft rotated by pulling the sliding box forward and backward forcing an orienting rod to move along in a non-straight groove in the shaft fixed through a side wall of the sliding box contained in a housing so that the shaft is rotated.

6 Claims, 5 Drawing Sheets

AUTOMATIC SCREW-DRIVING DEVICE

BACKGROUND OF THE INVENTION

There are automatic screw driving tools such as U.S. Pat. Nos. 4,059,034 and 3,930,297, include a sprocket member to move a screw belt and a pawl and a pin to prevent the sprocket member from rotating reversely. But stopping function of the pawl and the pin is not good, and in addition, a slide member has a cylindrical recess unadjustable so that each screw-driving device only suite for one size of screws. So a user has to prepare a plurality of screw-driving device for 13–41 mm screws. One more drawback is that the sprocket member does not work accurately to move a screw belt because of difficulty in locking the sprocket member firmly.

The U.S. Pat. Nos. 3,930,297, and 3,910,324 can only fix screws in a horizontal direction, limited in practical function.

SUMMARY OF THE INVENTION

This invention has been devised to improve the drawbacks of the conventional automatic screw-driving devices above-mentioned, having objects and features described below.

1. One object of this invention is to offer an automatic screw-driving device which moves a screw belt with accuracy, and can be adapted to screws of any length.

2. One feature of this invention is provision of an adjustable cap to be moved to suit to any length of a screw, a to keep a screw from falling down before fixed, and to fix a screw both in a horizontal and a vertical direction.

3. Another feature is a plurality of pawls provided in a sprocket to push to move a screw belt.

4. Another feature is a one-way bearing for sustaining a shaft, fixed on one end of the shaft, restricting the sprocket member to rotate in one direction only.

5. Another feature is a plurality of bead holes in one side surface of the sprocket member for a bead to fit in one of them to secure stably the sprocket member at one of various positions after its rotation for a certain angle.

6. One more feature is a non-straight lengthwise groove in the shaft for an orienting rod to fit therein through a side wall of a housing so that the shaft may be rotated clockwise or counterclockwise by means of the orienting rod when a sliding box is moved sliding forward and backward in the housing.

DETAILED DESCRIPTION OF THE INVENTION

Figure 1:
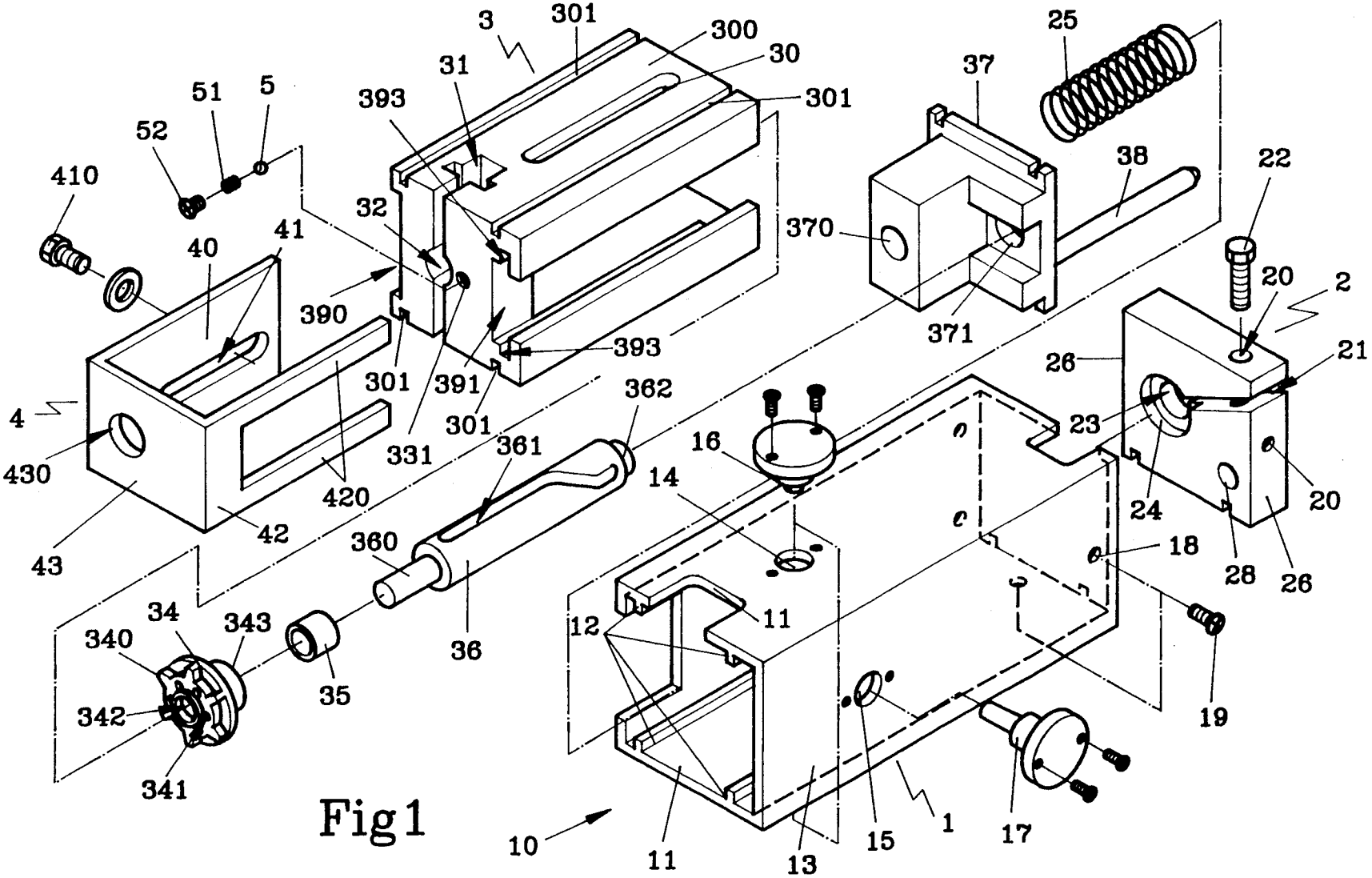
FIG. 1 is an exploded perspective view of an automatic screw-driving device in the present invention.
Figure 2:
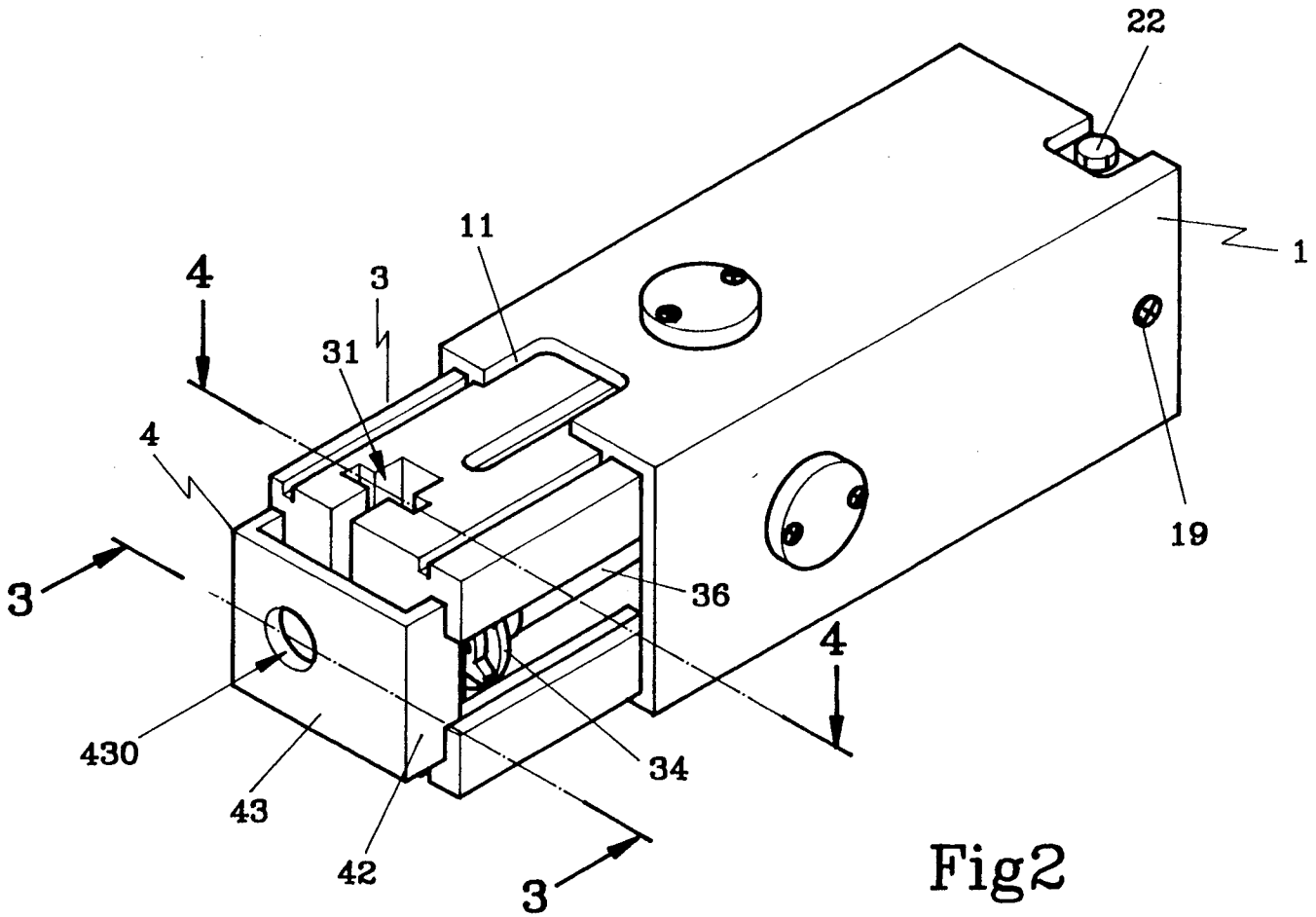
FIG. 2 is a perspective view of the automatic screw-driving device in the present invention.
Figure 3:
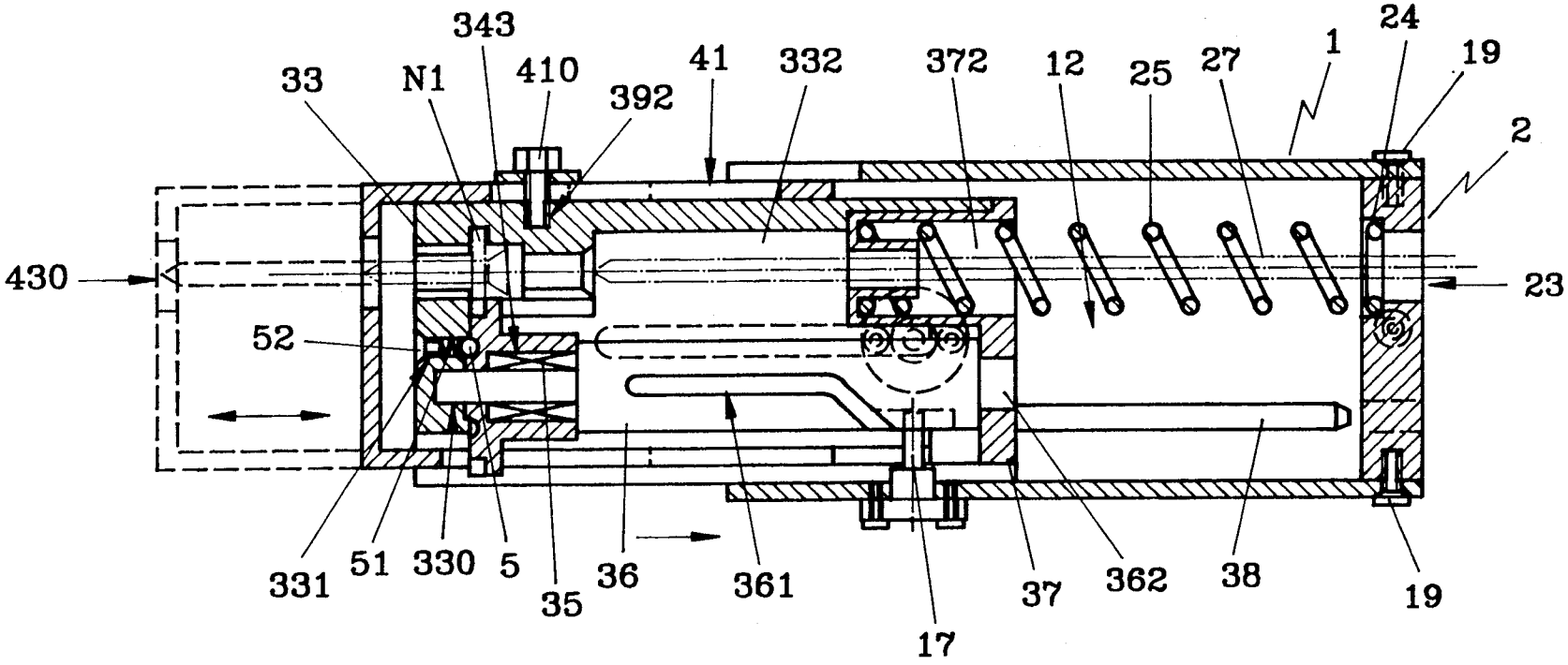
FIG. 3 is a cross-sectional view of line III—III in FIG. 2.

An automatic screw-driving device in the present invention, as shown in FIGS. 1–3, comprises a housing 1, a stop block 2, a sliding box 3, an adjustable cap 4, a sprocket member 34, a shaft 36 and a sustaining block 37 as its main components.

The housing 1 is preferably shaped as a hollow rectangular box, having a front side and a rear side open, a sliding box cavity 10, two parallel rails 12, 12 respectively spaced apart on an upper and a lower inner wall 11, 11 to engage two rail grooves 301, 301 respectively spaced apart in an upper and a lower wall 300, 300 of the sliding box 3, a through hole 14 in the upper wall 11 and a through hole 15 in a slide wall 13 for two orienting rods 16, 17 to extend through to respectively insert in a slot 30 of the sliding box 3 and a slot 361 of the shaft 36, and a threaded hole 18 in the side wall 13 for a screw to engage in and also in a threaded hole 20 of the stop block 2 to secure the stop block 2.

The stop block 2 has a slanting slot 21 for a bolt 22 to cross through so that an upper wall of the slanting slot 21 may be pressed down by rotating the bolt 22 so as to adjustingly narrow the width of the slot 21 and then to adjust the diameter of a driver through hole 23 to suit to the diameter of a driver to be used. The stop block 2 is fixed in the rear side opening of the housing 1, with both side walls 26, 26 fixed with the side walls of the housing 1 with screws. The driver through hole 23 is for a driver 27 to pass through and the driver 27 is to be rotated by an electric motor, and has a spring hole 24 at an opening of the through hole 23 for one end of a spring 25 to fit around.

Figure 6:
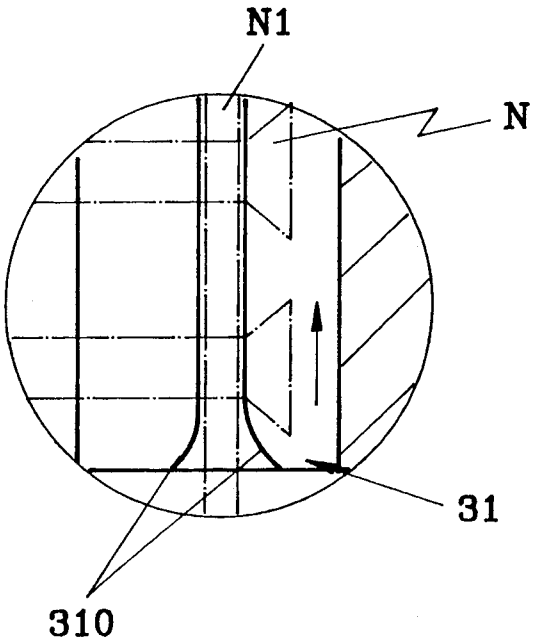
FIG. 6 is an enlarged view of part C in FIG. 5.
Figure 5:
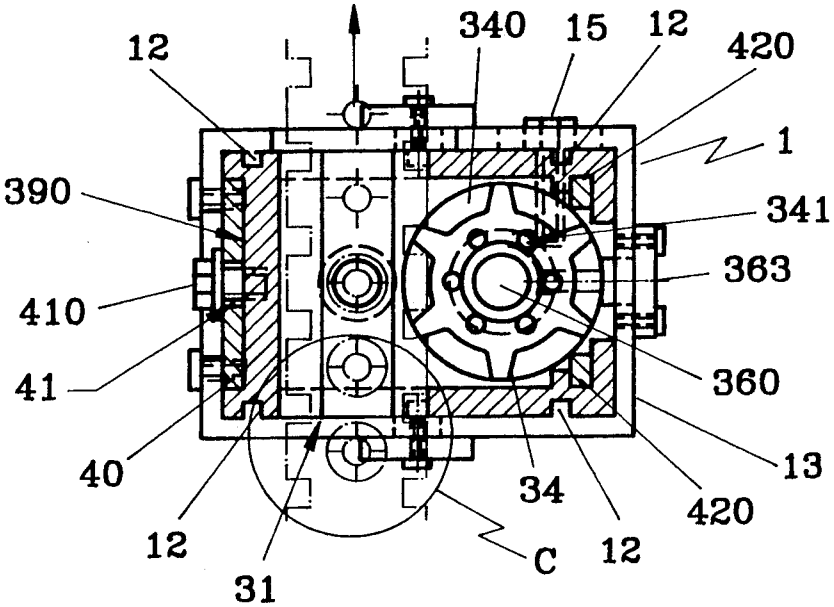
FIG. 5 is a cross-sectional view of line IV—IV in FIG. 2.

The sliding box 3 partly fits in the interior cavity 10 of the housing 1, having rail grooves 301 in an upper and a lower wall 300,300 to fit with the rails 12, 12 of the housing 1, a a lengthwise slot 30 in an upper wall for the orienting rod 16 to fit and move therein, a screw passageway 31 provided to extend vertically from the upper wall to the bottom for a screw belt N1 up therein and having a cross-shape with a curved hole 32 in an intermediate portion for a screw N to extend outward, and also having a curved wall 310 as shown in FIG. 6 at the bottom for the screws N to move smoothly up. The sliding box 3 also has a front side wall 33 provided with a shaft hole 330 horizontally extending rearward, a threaded hole 331, a hollow cavity 332 formed between the sliding box 3 and a sustaining block 37 for the driver 27, the shaft 36 etc. to be deposited therein.

Figure 4:
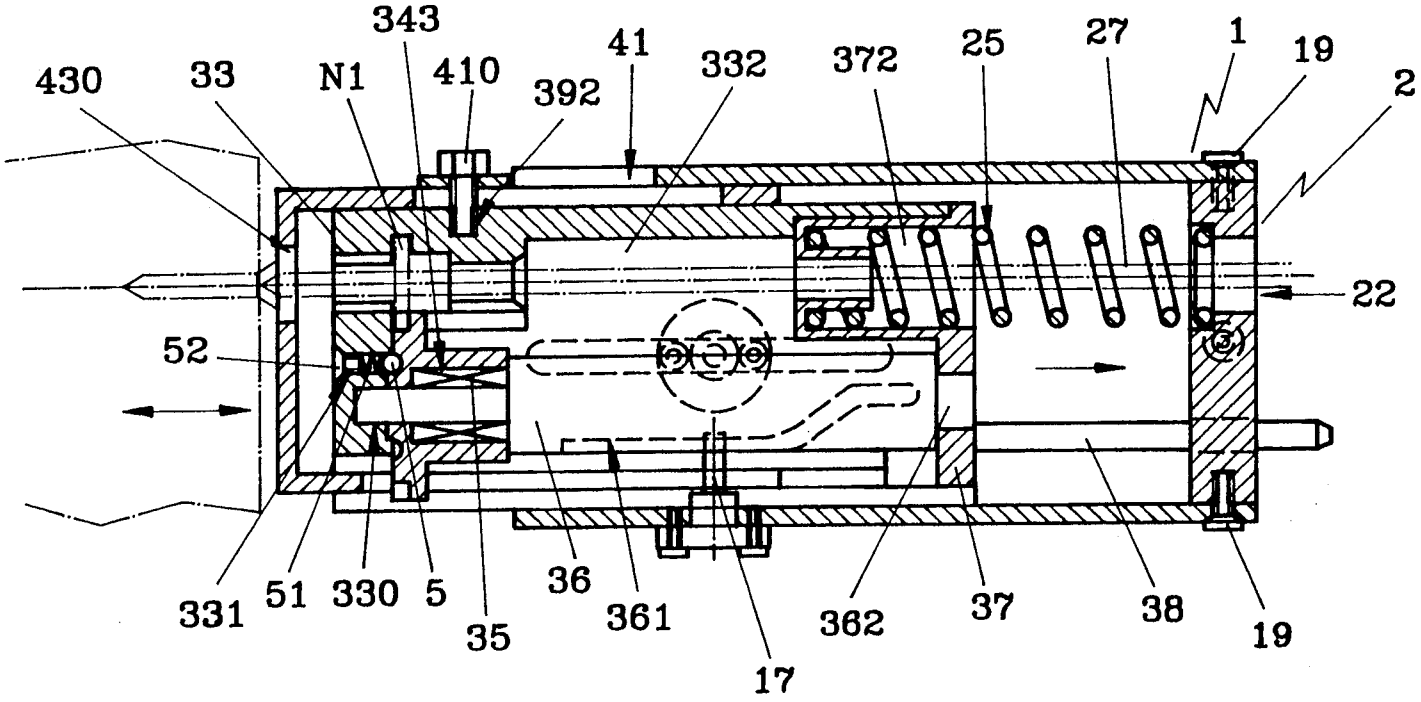
FIG. 4 is a cross-sectional and actional view of line III—III in FIG. 2.

The sprocket member 34 has a plurality of pawls 340 around the front side wall, a shaft hole 342 in the center for a front end of the shaft 36 to fit therein, a bearing hole 343 in a rear side communicating, with the central shaft hole 342 for a one-way bearing 35 to fit therein. The one-way bearing 35 is combined with a smallest diameter left end 360 of the shaft 36 as shown in FIGS. 3 and 4.

The shaft 36 has a smallest diameter left end portion 360, a largest diameter intermediate long portion and a medium diameter right end portion 362 and a non-straight groove 361 along in the intermediate portion for the orienting rod 17 to insert and move therein.

A locating bead 5, a spring 51 put behind the bead 5 and a screw 52 to force the spring 51 are provided to be deposited in a threaded hole 331 in the front side wall 33 of the sliding box 3 so that the bead 5 may engage in one of the bead holes 341 when the sprocket member 34 is rotated, and a bead hole 341 to fit with the bead 5 may also be changed.

The sustaining block 37 is combined behind the sliding box 3, having a driver hole 370, a shaft hole 371, a spring hole 372 for an end of a spring 25 to fit therein, and a long straight rod 38 to extend rearward for touching and turning on a switch of an electric motor to rotate the driver.

The sliding box 3 has a U-shaped guide groove 390 at one side and a cross-shaped guide groove 391 at the opposite side for the adjustable cap 4 to slide along these two grooves 390, 391 for adjustment. The adjustable cap 4 has a long slot 41 in a side wall 40 for a bolt 410 to engage a threaded hole 392 in the guide groove 390 and the opposite side wall 42 of a U-shape with two horizontal parallel guide rods 420, 420 to fit in two straight grooves 393 in an upper and a lower side of the guide groove 391. The front side wall of the adjustable cap 4 has a screw exit hole 430 for a screw to extend out. The adjustable cap 4 can be pulled to adjust its distance of extending out of the sliding box 3 by altering the location of the bolt 410 in the slot 41 of the side wall 40 so as to coordinate screws N of any length, preventing the screw from falling down before fixed.

The sliding box 3 is manually moved, forcing the shaft 36 to rotate, and then the sprocket member 34 is also rotated by the shaft 36 to move up the screw belt. At the same time the locating bead 5 keeps the sprocket member 34 in a certain position firmly so that a screw can be positioned in a pre-set location to be driven by a driver with correct accuracy, without any possibility of reverse rotation of the sprocket member 34 and of falling down of the screws before to be driven.

What is claimed is:

1. An automatic screw-driving device comprising;

a housing of a rectangular cross-sectional shape, having (1) an interior cavity for a sliding box to fit and move therein, (2) two rails on an upper and a lower inner wall for rail grooves of the sliding box to fit with, (3) two holes respectively in an upper wall and a slide wall for an orienting rod to pass through, two orienting rods respectively fitting in a long slot in a sliding box and a shaft;

a stop block fixed in a rear side opening of the housing;

a sliding box having (1) a screw passageway of a cross shape extending from an upper surface down to a bottom for a screw belt to enter an entrance in the bottom and to move up gradually and (2) a curved hole in an intermediate portion of the screw passageway for a screw to go out, (3) a front side wall provided with a shaft hole and a small threaded hole, (4) a hollow cavity formed with a sustaining block fixed in a rear side opening and (5) a guide opening respectively at two opposite sides;

a sprocket member combined just behind the front side wall of the sliding box, having (1) a plurality of pawls around its front circumference, (2) a plurality of bead holes around an front side surface, (3) a central shaft hole for one end of a shaft to fit therein, (4) a one-way bearing fixed in the shaft hole for sustaining the shaft. The shaft being placed between said sprocket member and said sustaining block fixed in a rear side opening of said sliding box, having a smallest diameter left end portion and a largest diameter intermediate long portion and a medium right end portion and a non-straight groove in the intermidiate portion, for a orienting rod to insert and move therein;

an adjustable cap of a U-shape being combined with the front portion of the sliding box to be pulled out or in of the sliding box, having (1) a horizontal slot in one side wall, (2) two horizontal parallel rods in the opposite side wall, and (3) a a screw exit hole in the front side wall; and said pawls of the sprocket member pushing and moving up the screw belt to locate a screw at a pre-set position for being driven, said sprocket member never rotating in a reverse direction even if said shaft is rotated in the reverse direction, said shaft having a lengthwise slot for the one of two orienting rods of the housing to fit therein and being rotated for an angle by the orienting rod in case of manually pulling the sliding box, said adjustable cap being pulled out of the sliding box to adjust a distance to extend out of the sliding box to suit to a screw to be driven.

2. The automatic crew-driving device as claimed in claim 1, wherein said stop block in the rear side of the housing has a slanting slot and the open distance of said slot can be adjusted by rotating a bolt extending through the slot, and thus a driver hole at an inner end of said slot can be adjusted by the bolt in its diameter to suit to a driver to be used.

3. The automatic screw-driving device as claimed in claim 1, wherein said screw passageway in the sliding box has a curved wall in the lower entrance for screws to enter smoothly therein.

4. The automatic screw-driving device as claimed in claim 1, wherein said pawls and the bead holes of the sprocket member are of the same number.

5. The automatic screw-driving device as claimed in claim 1, wherein said sprocket member is kept stably in one of various positions by means of a bead fitting in one of said bead holes.

6. The automatic screw-driving device as claimed in claim 1, wherein said lengthwise slot in the shaft is non-straight, enabling the shaft to rotate.

* * * * *